United States Patent [19]

Goodall

[11] Patent Number: 4,804,119

[45] Date of Patent: Feb. 14, 1989

[54] LIQUID DISPENSER

[76] Inventor: Donald T. Goodall, 30 Beach Street, Blakehurst, New South Wales, 2220, Australia

[21] Appl. No.: 24,870

[22] Filed: Mar. 13, 1987

Related U.S. Application Data

[63] Continuation of Ser. No. 805,556, Dec. 6, 1985, abandoned.

[51] Int. Cl.[4] ..... B65D 23/10

[52] U.S. Cl. ..... 222/468; 222/465.1; 222/538; 215/1 C

[58] Field of Search ..... 222/465 R, 475, 468, 222/538, 465.1, 108, 109, 539; 215/1 C, 31, 100 A

[56] References Cited

U.S. PATENT DOCUMENTS

| | | | |
|---|---|---|---|
| 308,106 | 11/1884 | Stimpson . | |
| 2,581,150 | 1/1952 | Shore | 222/538 X |
| 3,251,514 | 5/1966 | Speicher | 222/468 |
| 3,396,875 | 8/1968 | Finch | 222/456 |
| 3,434,635 | 3/1969 | Mason | 222/468 |
| 4,412,633 | 11/1983 | Guerrazzi et al. | 222/468 |

FOREIGN PATENT DOCUMENTS

| | | | |
|---|---|---|---|
| 100689 | 12/1964 | Denmark | 222/465 R |
| 767321 | 1/1957 | United Kingdom | 222/538 |

*Primary Examiner*—Charles A. Marmor

*Attorney, Agent, or Firm*—Niro, Scavone, Haller, Niro & Rockey, Ltd.

[57] ABSTRACT

A container including a neck portion leading to an outlet from the neck located outwardly thereof, the cross sectional area of the outlet being greater than the cross sectional area of the neck portion thereby providing a shoulder in the neck which in a pouring operation causes liquid flowing from the container to separate from an upper portion of the outlet and a duct communicating between the neck and the interior of the container whereby as liquid empties from the container in a pouring operation the resulting pressure differential arising between the interior of the container adjacent the inlet of the duct and the atomosphere draws air in an unimpeded manner into the container.

5 Claims, 2 Drawing Sheets

LIQUID DISPENSER

This application is a continuation of application Ser. No. 805,556, filed Dec. 6, 1985, now abandoned.

This invention relates to liquid containers and in particular to a liquid container having an improved pouring neck and outlet which does not interfere with the rapid filling of the container and permits the contents of the container to be dispensed in an even stream without the gulping phenomena which occurs in the dispensing of liquids from many containers currently in use.

The gulping phenomena is caused by the ingress of air into the container as the contents are dispensed therefrom. As the contents are dispensed from a container tilted to a pouring position there is a tendency to create a vacuum above the liquid level in the container, air is drawn into the container to progressively fill the vacuum. This ingress of air is opposite to the flow of the contents from the container and causes a gurgling of gupling effect resulting in an uneven flow of the contents from the container.

In an attempt to overcome this problem it has been proposed to include a duct in the container which permits air to flow into the vacuum in the container as the contents are dispensed therefrom without passing through the liquid stream flowing from the container. Such arrangements have prooved only partly successful and even with the provision of the mentioned duct, the fluid flow sometimes acludes the inlet in the container and so gulping does occur.

The object of the present invention is to provide a container of the general type referred to, which includes an air inlet duct and which permits and even flow of liquid from the container in a liquid dispensing operation.

The invention from one aspect comprises a container including a neck portion leading to an outlet from the neck located outwardly thereof, the cross sectional area of said outlet being greater than the cross sectional area, said neck portion thereby providing a shoulder in said neck which in a pouring operation causes liquid flowing from said container to separate from an upper portion of said outlet and a duct communicating between said neck and the interior of the container whereby as liquid empties from the container in a pouring operation the resulting pressure differential arising between the interior of the container adjacent the inlet of the duct and the atmosphere draws air in an unimpeded manner into said container.

The invention from a further aspect comprises a container including a conical shaped neck portion leading to a circular peripheral channel located outwardly of said neck and an outlet from said channel located outwardly thereof, the cross sectional area of said outlet being greater than the cross sectional area of said neck portion thereby providing a shoulder in said neck which in a pouring operation causes liquid flowing from said container to separate from an upper portion of said outlet and a duct communicating between said channel and the interior of the container whereby as liquid empties from the container in a pouring operation the resulting pressure differential arising between the interior of the container adjacent the inlet of said duct and the atmosphere draws air in an unimpeded manner into said container.

In a modification the neck of the container is provided with a pouring nozzle positioned in the container neck, said nozzle having abutment means thereon to limit the movement of the nozzle into and out of said container, the shoulder and the wall of the nozzle forming a well for the collection of liquid remaining on the outside of the nozzle after a pouring operation.

A preferred embodiment of the invention will now be described with reference to the accompanying drawings in which.

Figure 1:
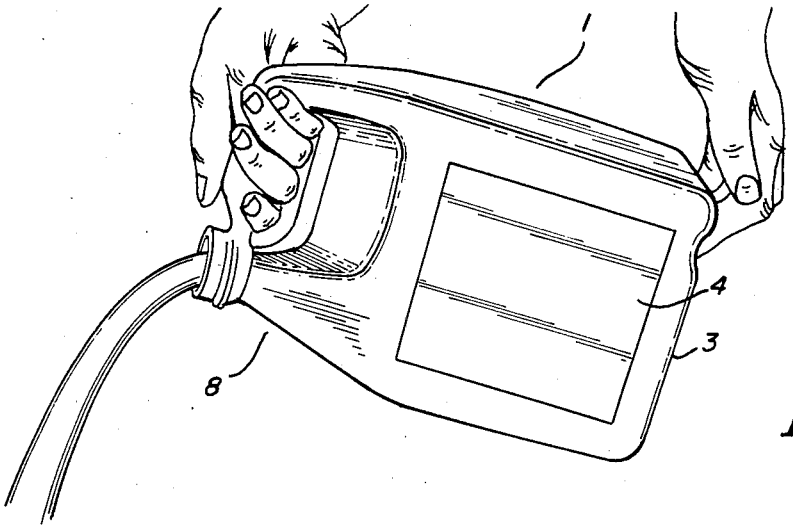
FIG. 1 is a perspective view of the container.
Figure 2:
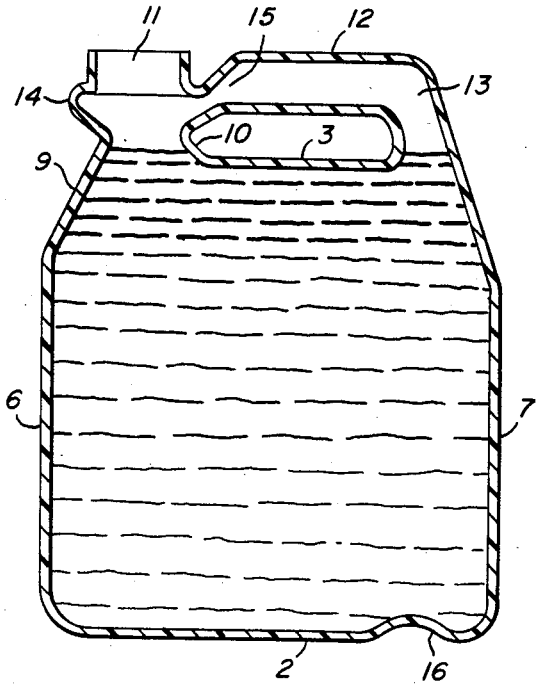
FIG. 2 is a side elevation.

Referring now to the drawings, the container 1 is rectangular shape, it has a bottom 2, top 3, side walls 4 and end walls 6 and 7.

End walls 6 and 7 are angled inwardly towards the centre of the container and are so shaped as to form a neck portion 8 defined by inwardly directed walls 9 and 10, an outlet 11 leads from the neck spaced to one side of the neck is a hollow carry handle 12 having a duct 13 passing therethrough which communicates with the neck 8 above the liquid level in the container and with the interior of the container.

The neck is formed with a circular peripheral channel 14 above the walls 9 and 10 which communicate with the inlet end 15 of the duct 13 and positioned above the channel is the circular shaped outlet 11, however the channel 14 is not essential to the performance of the invention.

The bottom of the container is provided with a finger recess 16 to facilitate the tilting of the container in a liquid dispensing operation as will be explained hereafter.

Figure 5:
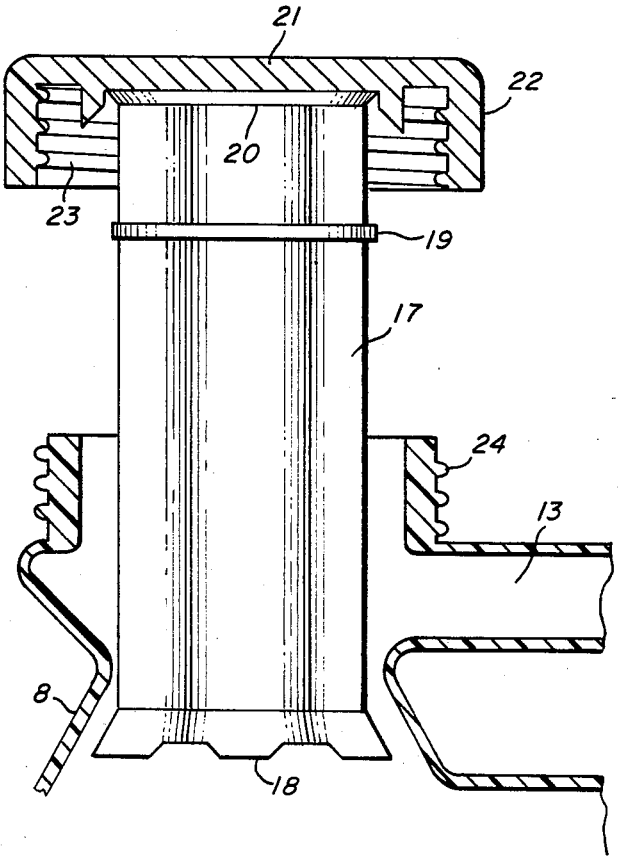
FIG. 5 is a view of the container showing a modification.

In the embodiment illustrated in FIG. 5, a pouring nozzle 17 is positioned within the neck 8. The nozzle has a flared bottom 18 which seals against the inner wall of the neck when the nozzle is in the dispensing position.

The nozzle is circular in shape and is provided with a circular abutment 19 intermediate its ends which limits the downward movement of the nozzle into the container and the free end of the nozzle is provided with a sealing bead 20 which is adapted to seal against an end cap 21. In the embodiment illustrated the side wall 22 of the end cap is threaded as at 23 and is engageable with a corresponding thread 24 on the container surrounding the outlet 11.

The length of the nozzle is such and the abutment 19 is so located that when the nozzle is pushed into the non-dispensing position it is located wholly within the container.

The nozzle 17 and the wall of the neck adjacent the outlet forms a well 25 which collects any liquid remaining on the outside surface of the nozzle after a dispensing operation and the dimension of the nozzle is such that this liquid can flow from the well into the body of the container through the duct 13 when the container is in a non-dispensing position.

Figure 3:
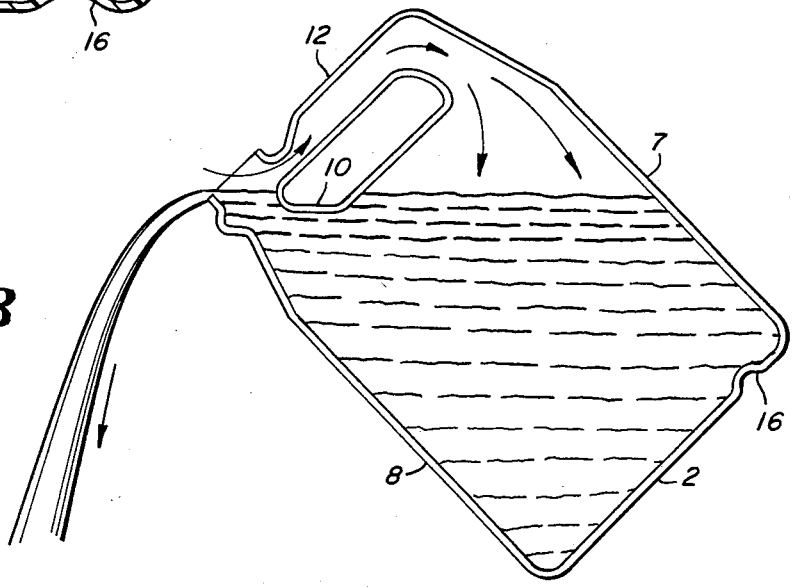
FIG. 3 is a view of the container in a partially tilted position.
Figure 4:
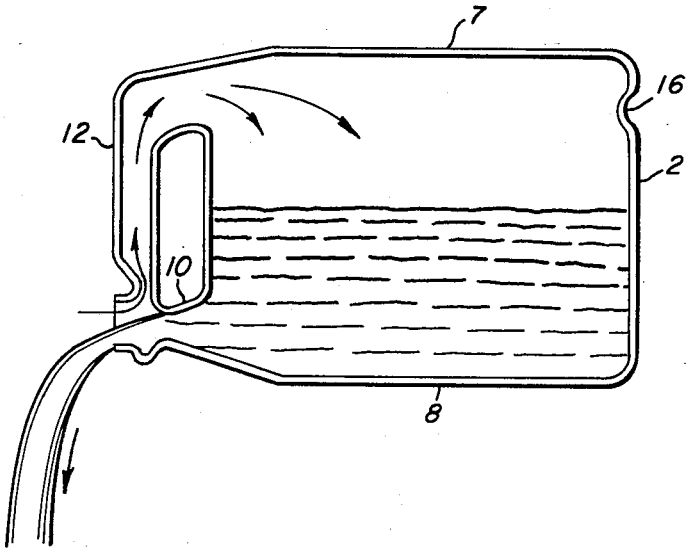
FIG. 4 is a view of the container in a fully tilted position.

As the liquid empties from the container in a pouring operation in the manner illustrated in FIGS. 1, 3 and 4 the resulting pressure differential arising between the interior of the container 1 adjacent the entrance 15 of the duct 13 and the atmosphere draws air back into the container as illustrated by the arrows in FIGS. 3 and 4 and into the container. The air displaces the liquid flowing from the container also in the direction of the arrows illustrated in FIGS. 3 and 4. The wall 10 causes the out flowing liquid to separate from the wall of the outlet 11 adjacent the inlet 15 of the duct 13 and the peripheral channel 14 provides an enlarged opening leading into the inlet 15 of the duct 13 thereby permitting a free uninterrrupted flow of air into the container in a pouring operation and thereby avoiding the gulping phenomena. This is particularly important in those cases where the container is to accommodate petroleum products or toxic liquids.

I claim:

1. A container having pouring means for dispensing liquid, said means including:

a neck portion of diminishing cross-sectional area leading to a peripheral channel of increasing cross-sectional area, said peripheral channel leading to an outlet having a greater cross-sectional area than the cross-sectional area of said neck portion said outlet being axially aligned with the neck but sufficiently larger in diameter so that, in a pouring operation liquid flowing from said container separates from an upper portion of said outlet, an air duct adjacent the upper portion of said outlet communicating with the upper portion of said container interior and of sufficient cross-sectional area throughout its length to maintain the interior of the container at substantially atmospheric pressure to maximize the rate of gulp-free dispensing of the liquid, said neck portion restricting liquid flow into the peripheral channel to maintain unimpeded air flow through said duct.

2. A container as claimed in claim 1 wherein said duct passes through a carrying handle for said container.

3. A container as claimed in claim 1 wherein the container bottom has a finger recess therein.

4. A container as claimed in claim 1 wherein the neck of the container is provided with a pouring nozzle positioned in the container neck, said nozzle having a flared bottom which seals against the inner wall of the neck, the nozzle having abutment means thereon to limit the movement of the nozzle into and out of said container, the shoulder, the wall of said outlet and the wall of the nozzle forming a well for the collection of liquid remaining on the outside of the nozzle after a pouring operation.

5. A container as claimed in claim 1 including a cap to close the container outlet.

* * * * *